United States Patent [19]

Weisbrod

[11] 4,055,760

[45] Oct. 25, 1977

[54] LAMP SHADE

[76] Inventor: Alfred L. Weisbrod, 1214 Valley Road, Villanova, Pa. 19085

[21] Appl. No.: 650,596

[22] Filed: Jan. 20, 1976

[51] Int. Cl.[2] ..... F21V 1/00

[52] U.S. Cl. ..... 362/352

[58] Field of Search ..... 240/108 D, 108 A, 108 R, 16/87.2; 24/67 AR

[56] References Cited

U.S. PATENT DOCUMENTS

| | | | |
|---|---|---|---|
| 2,292,024 | 8/1942 | Dreher | 24/67 AR X |
| 2,320,308 | 5/1943 | Silverman | 16/87.2 |
| 2,805,457 | 9/1957 | Vaca | 16/87.2 UX |
| 3,142,446 | 7/1964 | Okamoto | 240/108 D |
| 3,315,325 | 4/1967 | Cornelius | 24/67 AR |
| 3,557,362 | 1/1971 | White et al. | 240/108 D |
| 3,764,801 | 10/1973 | Mainieks | 240/108 D |
| 3,787,676 | 1/1974 | Korach | 240/108 R |

*Primary Examiner*—Donald A. Griffin
*Attorney, Agent, or Firm*—Seidel, Gonda & Goldhammer

[57] ABSTRACT

A lamp shade which is adapted to be shipped in a flat disassembled condition comprised of two rings and a cover sheet. Each ring has a plurality of circumferentially disposed members thereon which are adapted to be adhesively secured to a portion of the cover sheet when the lamp shade is assembled.

8 Claims, 7 Drawing Figures

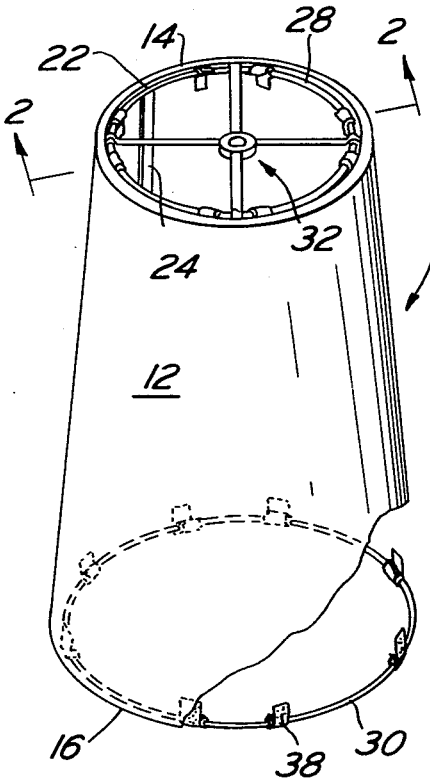
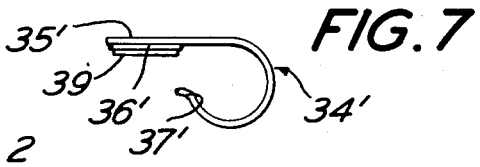
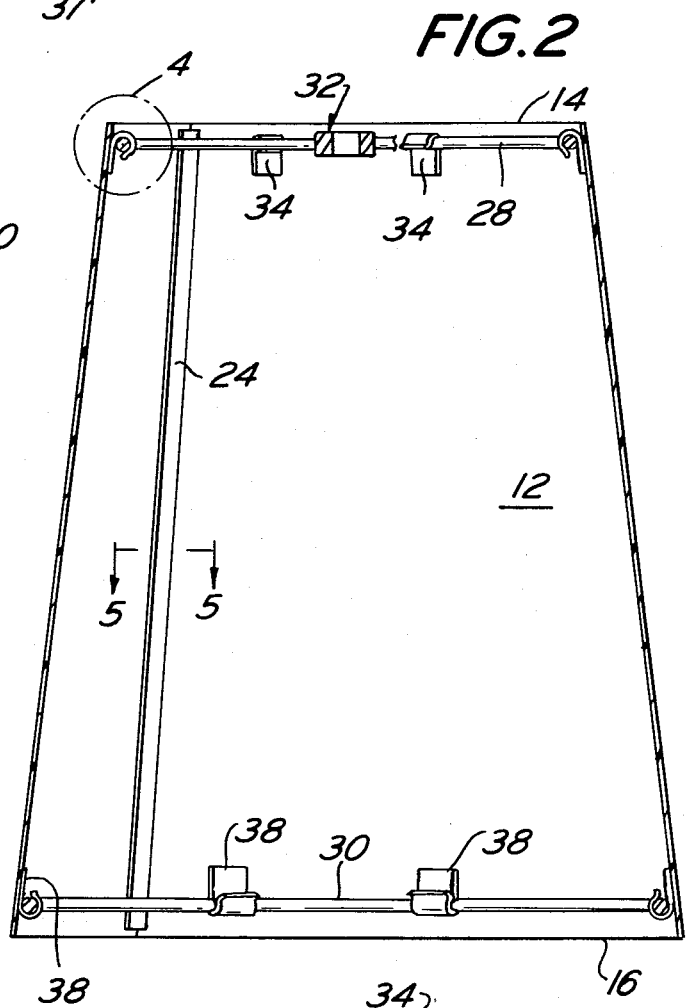
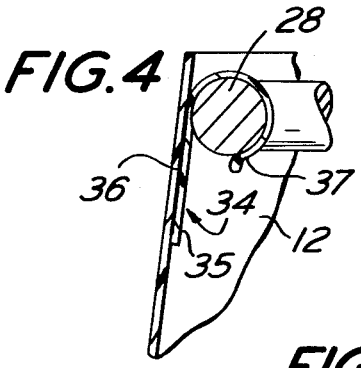
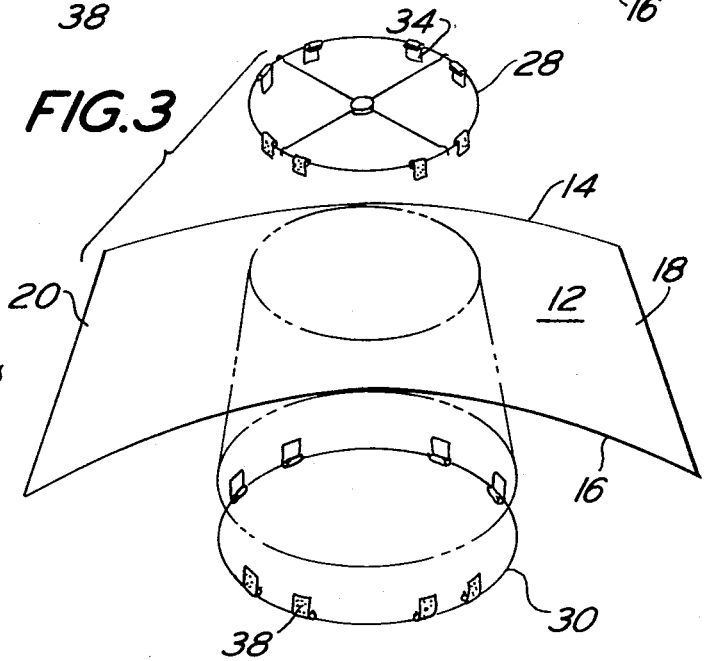
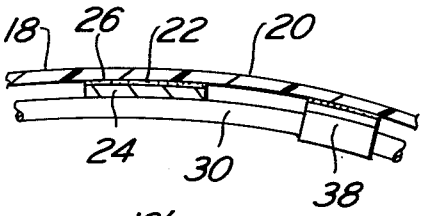
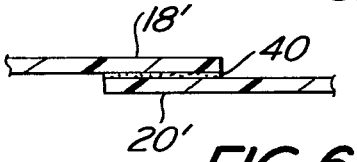
FIG. 6

LAMP SHADE

BACKGROUND

A substantial factor in the cost of lamp shades is the cost of freight charges. Freight charges for lamp shades are based on volume. An assembled lamp shade takes up substantial volume, most of which is air. Approximately 10 to 20% of lamp shades are damaged in shipment. Assembled lamp shades require substantial storage space on behalf of the manufacturer, the distributor and the retailer.

The present invention is directed to solution of the problems described above.

DISCLOSURE

The lamp shade of the present invention is adapted to be shipped in a flat disassembled condition. Two rings may be shipped separately or in a package with a flat cover sheet of a self supporting material. The lamp shade is adapted to be assembled at the point of distribution such as a store or at the customer's home after purchase of the same. The components of the lamp shade are structurally interrelated in a manner so as to facilitate rapid and easy assembly of the lamp shade by persons having little or no skill.

Each of the rings has a plurality of circumferentially disposed members thereon. Each of said members is adapted to be adhesively secured to a portion of the cover sheet. The rings are maintained in spaced relation by the cover sheet. A means is provided to join the free edges of the cover sheet.

It is an object of the present invention to provide a lamp shade which may be shipped in a flat condition so as to materially reduce shipping and freight costs while at the same time minimizing damage during shipment.

It is another object of the present invention to provide a lamp shade which may be shipped in a flat condition but assembled in a rapid manner with little or no skill.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a partial perspective view of a lamp shade in accordance with the present invention.

FIG. 2 is a sectional view taken along the line 2—2 in FIG. 1.

FIG. 3 is an exploded view of the components of the lamp shade as shipped from the factory.

FIG. 4 is an enlarged detailed view of the structure within the circle in FIG. 2.

FIG. 5 is a sectional view taken along the line 5—5 in FIG. 2.

FIG. 6 is a sectional view similar to FIG. 5 but showing an alternative joint between the edges of the cover sheet.

FIG. 7 is an end view of an alternative mounting member.

Referring to the drawing in detail, wherein like numerals indicate like elements, there is shown in FIG. 1 a lamp shade in accordance with the present invention designated generally as 10.

The lamp shade 10 includes a cover sheet 12 adapted to be shipped in a flat condition as shown in FIG. 3. The cover sheet 12 has a top edge 14, a bottom edge 16, and mating side edge portions 18 and 20. In the assembled lamp shade 10, the edge portions 18 and 20 are coupled together with a butt joint 22. See FIG. 5.

In the assembled lamp shade 10, the edge portion 18 and 20 of the cover sheet 12 are maintained in the operative disposition by a strip 24 having adhesive 26 on its inner surface. The adhesive 26 bonds the strip 24 to each of the edge portions 18 and 20. Adhesive 26 is preferably a pressure sensitive adhesive. For purposes of shipping, the adhesive 26 is protected by a paper protective cover layer which is removed before the strip 24 is applied. Strip 24 is preferably of the same color or the same material as the cover sheet 12.

The cover sheet 12 is preferably made from a self supporting material whereby it can stand when supported from below while maintaining the top ring 28 spaced from the bottom ring 30. Per se, lamp shade cover sheets of a self supporting material are known. One such material for the cover sheet 12 may be a polymeric plastic material such as polyethylene having a thickness of about 0.015 inches.

The top and bottom rings 28, 30 may be made of a variety of materials but preferably are preformed metal rings. One of the rings, such as ring 28, is provided with a spider 32 or an equivalent structure to facilitate mounting the lamp shade on a lamp base. The spider 32 may be of conventional construction having struts extending radially inwardly from the ring 28 and terminating in an annular hub.

The top ring 28 is provided with a plurality of cover sheet mounting members 34. The members 34 are preformed J-shaped and circumferentially disposed on the ring 28. As shown more clearly in FIG. 4, each mounting member 34 includes a free end portion in the form of a tab 35 and a jaw portion 37 which surrounds and is snapped on the ring 28 so that the tab may be pivoted to any desired angular disposition with respect to the vertical axis of the lamp shade 10. The tab 35 of each mounting member 34 is adapted to be adhesively secured to a juxtaposed portion of the upper end of the cover sheet 12. This is preferably accomplished by providing a pressure sensitive adhesive 36 on the tab 35 of each member 34. A paper cover layer is preferably provided in overlying relationship to the adhesive 36 and is adapted to be removed therefrom before the components of the lamp shade 10 are assembled.

The bottom ring 30 is similarly provided with a plurality of similar mounting members 38. each of the mounting members 38 is pivotably coupled to the ring 30 and adapted to be manually positioned in any desired angular disposition with respect to the longitudinal axis of the lamp shade 10 in the same manner as described above.

In the illustrated embodiment, the lamp shade 10 has been shown in a form of a frustrated cone due to the fact that the top ring 28 is smaller in diameter than the bottom ring 30. It is within the scope of the present invention to use top and bottom rings of the same diameter whereby the cover sheet 12 will be in the form of a cylinder rather than a frustrated cone in its operative disposition. A single ring such as top ring 28 may be utilized in one lamp shade having a frustrated cone shape or in another lamp shade having a cylindrical shape. One advantage resulting therefrom is that a store may custom form any desired lamp shade merely by having a supply of top and bottom rings of different diameters. Since the mounting members 34, 38 are pivotable, any top ring 28 may be used with any bottom ring 30 of the same or different diameters.

The rings 28, 30, the cover sheet 12 and the strip 24 are shipped in a flat condition from the factory in the same or separate cartons. To assemble the lamp shade 10, the protective layer for the adhesive 26 is removed. Thereafter, the edge portions 18 and 20 are held in assembled relationship and strip 24 applied thereto as shown in FIG. 5. This results in a self supporting cover sheet.

Thereafter, the protective cover for the adhesive 36 is removed from each of the mounting members 34, 38. The adhesive 36 on each member 34 is pressed into contact with the inner surface of the cover sheet 12 adjacent the upper end thereof. Likewise, the pressure sensitive adhesive on each tab portion of each mounting member 38 is pressed into contact with the inner surface of the cover sheet 12 adjacent the bottom end thereof. The thickness of the strip 24 is not more than the thickness of the mounting members 34 and 38. No skill is required to effect the above described assembly which is accomplished in a matter of minutes.

The strip 24 may be eliminated if desired. In this regard, a layer of pressure sensitive adhesive 40 is applied to one of the mating edge portions 18', 20' so as to form a lap joint in the assembled disposition of the cover sheet 12 as shown in FIG. 6. A protective removable layer should be provided for the layer of adhesive 40 which is preferably a pressure sensitive adhesive.

Since the components of the lamp shade 10 are shipped flat in the same or different cartons, the cost of freight and/or storage space is substantially minimized. At the same time, damage during shipment is substantially minimized because the lamp shade has not yet been assembled into its desired shape.

The mounting members 34, 38 are pivotable on their respective rings and preferably are a resilient material which may be either metal or plastic so that jaw portion 37 may flex as the members are snapped onto their respective rings. In addition to being pivotable about the respective rings, each of the mounting members 34, 38 is slidable along at least a portion of its ring so that the mounting members for purposes of aesthetics may be equally spaced on their respective rings. The mounting members 34 and 38 are preferably applied to the rings 28 and 30 at the factory but may be shipped separately for snap-on application to the rings by the customer.

In the above description, mounting members 34, 38 and their respective rings are adapted for positioning within the lamp shade 10. The rings and their mounting members may be on the outer surface of the lamp shade by using a member such as mounting member 34'. Member 34' is the same as member 34 or 38 except that the pressure sensitive adhesive 36' is on the inner surface of the tab 35' adjacent the jaw portion 37'. The pressure sensitive adhesive 36' is protected by an expendable layer of non-adhering paper 39.

A typical ring 28 or 30 is made of wire stock having a diameter of about 0.120 inches. The minimum distance from tab 35 to jaw portion 37 is about 0.080–0.090 inches. Jaw portion 37 is rounded at its tip to facilitate flexing away from tab 35 when pressure is applied to snap the members on their rings. The layer of adhesive 36, 36' on the mounting members 34, 34', 38 is preferably protected by a non-adhering expendable layer of paper.

A customer may readily remove sheet 12 and substitute therefor a cover sheet of a different color or material. Such substitution may be motivated by aesthetics or to replace a damaged cover sheet. In addition to polyethylene, cover sheet 12 may be made from other self-supporting materials including polypropylene, parchment, paper or fabric coated with a thin layer of polymeric plastic material, etc. If desired, spider 32 may be a separate component attachable to a ring whereby any ring may be a top or bottom ring.

The present invention may be embodied in other specific forms without departing from the spirit or essential attributes thereof and, accordingly, reference should be made to the appended claims rather than to the foregoing specification as indicating the scope of the invention.

I claim:

1. A lamp shade adapted to be shipped in a flat disassembled condition for subsequent assembly comprising two rings, a flat cover sheet of self supporting material, said rings having a plurality of members circumferentially disposed thereon, each of said members being adapted to be adhesively secured to a juxtaposed portion of said cover sheet with the rings in spaced relation, said members being pivotably secured to their respective rings and slidable along their respective rings, and means to join the free edges of said sheet.

2. A lamp shade in accordance with claim 1 wherein each of said members includes a tab portion having a layer of pressure sensitive adhesive thereon and another portion pivoted to one of said rings.

3. A lamp shade in accordance with claim 1 wherein each of said rings has a diameter which is less than the diameter of a closed figure attained by joining the free edges of said sheet.

4. A lamp shade in accordance with claim 1 wherein said means to join the free edges of said sheet includes a strip having a layer of adhesive thereon, said strip being of substantially the same axial length as said cover sheet.

5. A lamp shade comprising a top ring, a bottom ring, a cover sheet of self supporting material, said cover sheet having free edges, means joining said free edges, said rings being juxtaposed to and concentric with the shape defined by said cover sheet, each of said rings having a plurality of members circumferentially disposed thereon, each of said members being adhesively secured to a portion of said cover sheet on the surface of the shape defined by said cover sheet, and each of said members being pivotable on their respective rings and slidable along their respective rings.

6. A lamp shade in accordance with claim 5 including a strip adhesively secured to mating edge portions of said cover sheet which have a butt joint.

7. A lamp shade in accordance with claim 5 wherein said cover sheet is an opaque polymeric plastic material having a thickness of about 0.015 inches.

8. A lamp shade in accordance with claim 5 wherein said free edges of said cover sheet are adhesively joined with a lap joint.

* * * * *